US006453479B1

(12) United States Patent
Parsons et al.

(10) Patent No.: US 6,453,479 B1
(45) Date of Patent: Sep. 24, 2002

(54) FLUSHER HAVING CONSISTENT FLUSH-VALVE-CLOSURE PRESSURE

(75) Inventors: Natan E. Parsons, Brookline; Kay Herbert, Winthrop, both of MA (US)

(73) Assignee: Arichell Technologies, Inc., West Newton, MA (US)

( * ) Notice: Subject to any disclaimer, the term of this patent is extended or adjusted under 35 U.S.C. 154(b) by 0 days.

(21) Appl. No.: 09/761,408

(22) Filed: Jan. 16, 2001

(51) Int. Cl.[7] ..... E03D 1/34
(52) U.S. Cl. ..... 4/378; 4/354; 4/366
(58) Field of Search ..... 4/378, 379, 380, 4/354, 366, 367, 361, 356, 357, 358, 359, 353; 251/41, 29, 45

(56) References Cited

U.S. PATENT DOCUMENTS

| | | | | |
|---|---|---|---|---|
| 2,760,204 A | | 8/1956 | Joanis | |
| 2,858,546 A | | 11/1958 | Tekenos et al. | |
| 3,677,294 A | * | 7/1972 | Gibbs et al. | |
| 3,747,621 A | * | 7/1973 | Tine | |
| 3,817,279 A | | 6/1974 | Larson | |
| 3,817,489 A | | 6/1974 | Caron et al. | |
| 3,820,171 A | | 6/1974 | Larson | |
| 3,820,754 A | | 6/1974 | Caron et al. | |
| 3,905,050 A | * | 9/1975 | Goza et al. | 4/358 |
| 4,003,399 A | * | 1/1977 | Fischer | 4/353 |
| 4,034,423 A | | 7/1977 | Milnes | |
| 4,060,857 A | * | 12/1977 | Couton | 4/362 |
| 4,077,602 A | | 3/1978 | Klessig | |
| 4,141,091 A | | 2/1979 | Pulvari | |
| 4,193,145 A | | 3/1980 | Gross et al. | |
| 4,233,698 A | | 11/1980 | Martin | |
| 4,304,015 A | | 12/1981 | Hubatka | |
| 4,357,720 A | | 11/1982 | Stahli | |
| 4,499,615 A | * | 2/1985 | Radovsky | 4/366 |
| 4,575,880 A | | 3/1986 | Burgess | |
| 4,646,780 A | * | 3/1987 | Spooner | 4/353 |
| 4,662,395 A | | 5/1987 | Strangfeld | |
| 4,707,868 A | * | 11/1987 | Hennessy | 4/354 |

(List continued on next page.)

FOREIGN PATENT DOCUMENTS

| | | |
|---|---|---|
| EP | 312750 B1 | 4/1991 |
| EP | 0828103 A1 | 3/1998 |
| GB | 1332995 | 10/1973 |
| GB | 2277108 A | 10/1994 |
| GB | 2277750 A | 11/1994 |
| GB | 2329452 A | 3/1999 |
| WO | WO 98/06910 | 2/1998 |
| WO | WO 98/10209 | 3/1998 |

*Primary Examiner*—Gregory Huson
*Assistant Examiner*—Khoa Huynh
(74) *Attorney, Agent, or Firm*—Frieze Cramer Cygelman Rosen & Huber LLP

(57) ABSTRACT

A tank-type flusher including an intake valve, a diaphragm-operated flush valve, a pressure control mechanism. The intake valve is connected to an external water source and constructed to close water flow to a water storage tank at about a predefined water level in the water tank. The diaphragm-operated flush valve is constructed to control a flush valve member between a seated state and an unseated state that allows water discharge from the water tank into a toilet bowl. The diaphragm separates a pressure chamber and a pilot chamber. The diaphragm is arranged to seal the pressure chamber to maintain pressure forcing the flush valve member to the seated state thereby preventing the water discharge from the water storage tank to the toilet bowl. The pressure control mechanism is constructed an arranged, upon actuation, to reduce pressure in the pilot chamber of the diaphragm-operated flush valve thereby reduce pressure in the pressure chamber causing the water discharge. The tank-type flusher also includes a manifold that supplies pressurized water through a pressurizer conduit to the pressure chamber. A check valve maintains the pressure in the pressure chamber that keeps the flush valve closed, despite loss in source pressure.

20 Claims, 8 Drawing Sheets

U.S. PATENT DOCUMENTS 4,756,031 A 7/1988 Barrett
4,832,310 A 5/1989 Nestich
4,941,215 A 7/1990 Liu
5,003,643 A 4/1991 Chung
5,005,226 A * 4/1991 Basile et al. ..... 4/354
5,046,201 A * 9/1991 Steinhardt et al.
5,187,818 A 2/1993 Barrett, Sr. et al.
5,313,673 A 5/1994 Saadi et al.
5,335,694 A 8/1994 Whiteside
5,341,839 A 8/1994 Kobayashi et al.
5,361,426 A 11/1994 Martin
5,400,446 A 3/1995 Bloemer et al.
5,431,181 A 7/1995 Saadi et al.
5,435,019 A * 7/1995 Badders
5,603,127 A 2/1997 Veal
5,649,686 A 7/1997 Wilson
5,652,970 A 8/1997 Wodeslavsky
5,802,628 A * 9/1998 Spoeth et al.
5,884,667 A 3/1999 North
5,920,919 A * 7/1999 Chang
5,970,527 A * 10/1999 Martin et al.

* cited by examiner

FLUSHER HAVING CONSISTENT FLUSH-VALVE-CLOSURE PRESSURE

BACKGROUND OF THE INVENTION

1. Field of the Invention

The present invention is directed to toilet flushing. It finds particular application in tank-type flushers.

2. Background Information

The art of toilet flushers is an old and mature one. (We use the term toilet here in its broad sense, encompassing what are variously referred to as toilets, water closets, urinals, etc.) While many innovations and refinements in this art have resulted in a broad range of approaches, flush systems can still be divided into two general types. The first is the gravity type, which is used in most American domestic applications. The gravity type uses the pressure resulting from water stored in a tank to flush the bowl and provide the siphoning action by which the bowl's contents are drawn from it. The second type is the pressurized flusher, which uses line pressure more or less directly to perform flushing.

Some pressure-type flushers are of the tank type. Such flushers employ pressure tanks to which the main water-inlet conduit communicates. Water from the main inlet conduit fills the pressure tank to the point at which air in the tank reaches the main-conduit static pressure. When the system flushes, the water is driven from the tank at a pressure that is initially equal to that static pressure, without reduction by the main conduit's flow resistance. Other pressure-type flushers use no pressure tank, and the main conduit's flow resistance therefore reduces the initial flush pressure.

While flush-mechanism triggering has historically been performed manually, there is also a long history of interest in automatic operation. Particularly in the last couple of decades, moreover, this interest has resulted in many practical installations that have obtained the cleanliness and other benefits that automatic operation affords. As a consequence, a considerable effort has been expended in providing flush mechanisms that are well adapted to automatic operation. Automatic operation is well known in pressure-type flushers of the non-tank variety, but gravity-type flushers and pressurized flushers of the tank- variety have also been adapted to automatic operation.

European patent publication EPO 0 828 103 A1 illustrates a typical gravity arrangement. The flush-valve member is biased to a closed position, in which it prevents water in the tank from flowing to the bowl. A piston in the valve member's shaft is disposed in a cylinder. A pilot valve controls communication between the main (pressurized) water source and the cylinder. When the toilet is to be flushed, only the small amount of energy required for pilot-valve operation is expended. The resultant opening of the pilot valve admits line pressure into the cylinder. That pressure exerts a relatively large force against the piston and thereby opens the valve against bias-spring force. Pilot valves have similarly been employed to adapt pressure-type flushers to automatic operation.

Commonly assigned copending U.S. application Ser. No. 09/544,800, which was filed on Apr. 7, 2000, by Parsons et al. for an Automatic Tank-Type Flusher and is hereby incorporated by reference, describes an arrangement in which the flush valve is biased to its unseated state, in which it permits flow from the tank to the bowl, and it uses line pressure to hold the flush valve shut rather than to open it. That approach tends to make it relatively simple to have a repeatable valve-opening profile. Also, high line pressure actually aids in preventing leakage through the flush valve; unlike some other arrangements, such pressure does not tend to reduce the flush-valve seal's effectiveness. Since the toilet's suction generation is principally dependent on the valve-opening profile, and since this approach makes the bias mechanism essentially the sole determinant of that profile, that approach makes the valve-opening aspect of flush operation largely independent of line pressure.

As is indicated in commonly assigned U.S. patent application Ser. No. 09/716,870, filed on Nov. 20, 2000, by Parsons et al. for a Timed Fluid-Linked Flush Control and hereby incorporated by reference, moreover, that approach has applicability not only to automatic flushers but also to flushers that are manually operated.

SUMMARY OF THE INVENTION

We have recognized that this approach to flush control can be further improved so that this approach results not only in more-effective valve opening but also in more-effective valve closing. According to one aspect of the invention, a flow diverter operated by the flush valve impedes or prevents tank filling while the flush valve is in its open state. This limits line-pressure reduction that the filling operation might otherwise cause, so the line pressure available to close the flush valve tends to be better preserved.

In accordance with another aspect of the invention, a flow controller is interposed in the path by which the line pressure is applied to the flush valve to close it. The flow controller can be of any of the many types that tend to reduce pressure variation. By so including such a flow controller in that pressurizing path, a system employing that feature exhibits relatively consistent flush-valve-closing performance despite variations in line pressure.

In accordance with yet another aspect of the invention, a check valve is included in the path by which fluid to apply closing pressure to the flush valve is delivered to it. By employing this feature, the flush system can maintain flush-valve-sealing pressure despite a temporary loss in line pressure.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
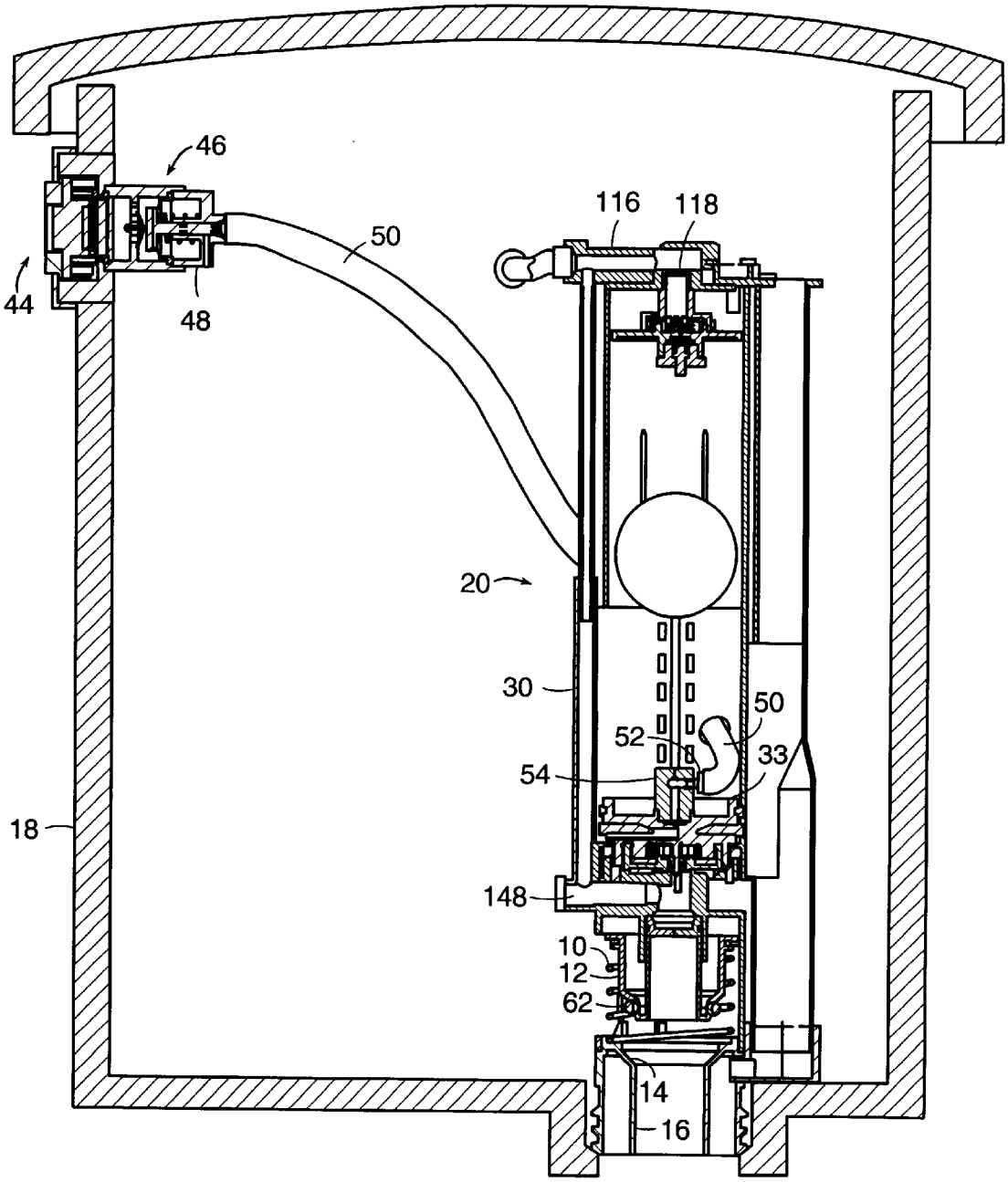
FIG. 1 is a sectional view of the toilet tank illustrating its float and gravity-type flush valves.
Figure 2:
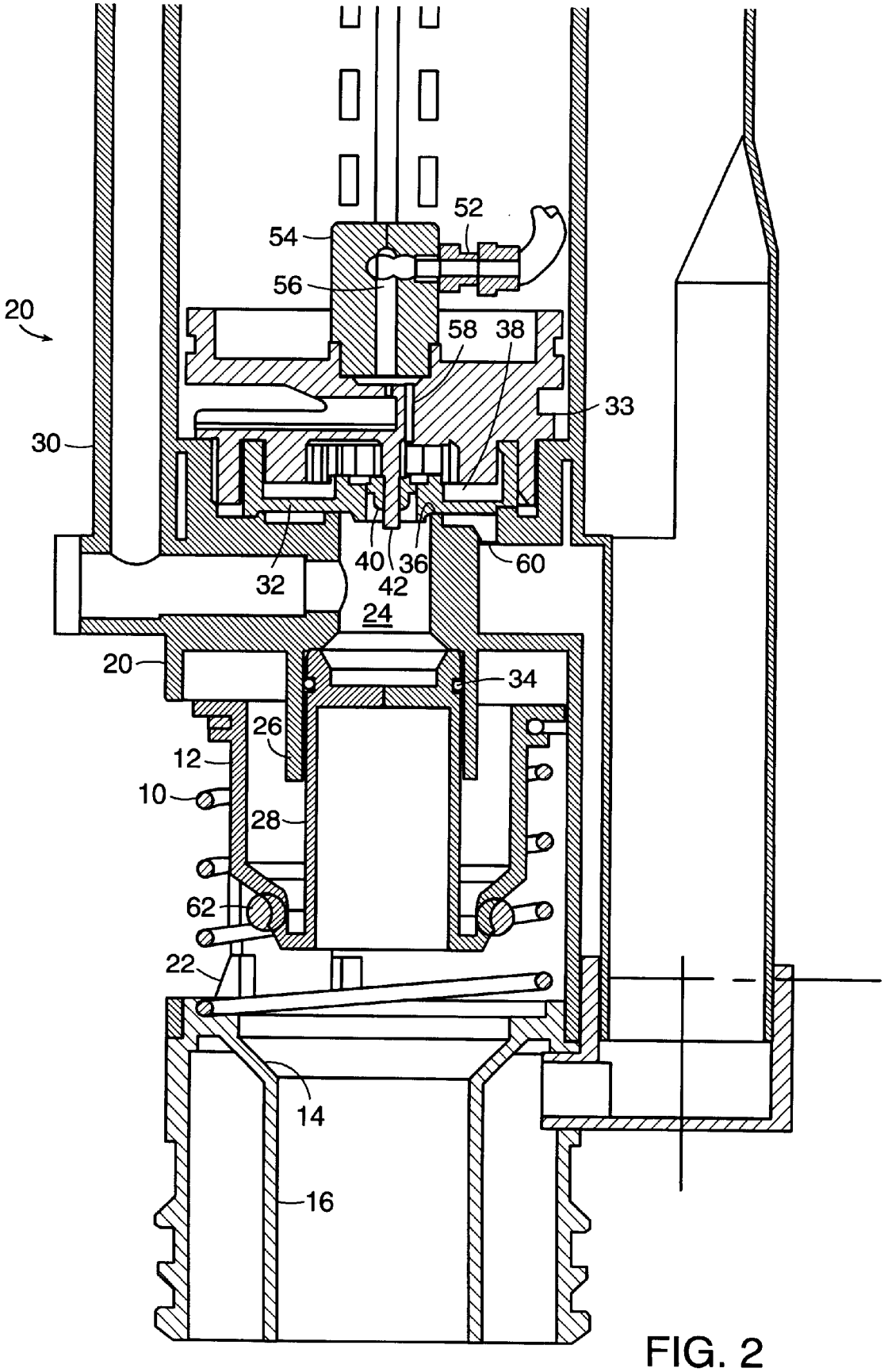
FIG. 2 is a more-detailed cross section of the flush-valve mechanism.

In the state that FIG. 1 depicts, a bias spring 10 keeps a gravity-type flush mechanism's flush-valve member 12 separated from a flush-valve seat 14 formed on the inlet of a flush conduit 16 disposed in the bottom of a toilet tank 18. As FIG. 2 shows in more detail, a lower main housing half 20 mounted by struts 22 on the flush conduit 16 forms a pressure chamber 24 above the valve member 12. The pressure chamber, which is partially defined by a cylinder 26 within which a piston portion 28 of the valve member 12 is slideable, is ordinarily under pressure because of fluid communication that a pressure line 30 provides between it and a pressurized-water supply. When that pressure prevails, it holds the valve member 12 in a seated position rather than the illustrated, unseated position.

Pressure chamber 24's pressure ordinarily prevails because a pilot-valve diaphragm 32 secured in housing half 20 by a pilot-valve cap 33 ordinarily cooperates with the valve member's seal ring 34 to prevent escape of pressurized water from the chamber. The pilot-valve diaphragm 32 is resiliently deformable, so the pressure that prevails within chamber 24 would tend to lift it from engagement with a pilot-valve seat 36 and thus allow pressure relief if a similar pressure did not prevail within a pilot chamber 38 and act on the diaphragm 32 over a greater area. The reason why this pressure prevails within the pilot chamber 38 is that a small orifice 40 through which a pilot-valve pin 42 formed by cap 33 extends permits water to bleed (through a relatively high flow resistance) into the pilot chamber. So the valve member 12 remains in the seated position (not shown) between flushes.

To cause the system to flush, the user depresses a push button 44 (FIG. 1). As will be explained in more detail below, this causes a remote pressure-relief valve 46 to permit flow to its outlet 48 from a pressure-relief tube 50 secured at its other end by a fitting 52 to a plug member 54 mounted on cap 33. This places the remote valve 46's outlet 48 in communication with a plug member 54's interior passage 56 (FIG. 2) and thereby with the pilot chamber 38 through passage 58. This relieves pressure in that chamber. The flow resistance of the path is much lower than that of the bleed orifice 40, by which the pilot valve's pressure is replenished, so the pressure within chamber 38 drops and permits pressure chamber 24's pressure to raise diaphragm 32 off its seat. The diaphragm thus serves as a pressure-relief valve. Specifically, it permits the pressure within the pressure chamber 24 to be relieved through a plurality of openings such as opening 60. As a consequence, the bias spring 10 can overcome the force exerted by the now-reduced pressure within chamber 24. The flush-valve member 12 therefore rises to its FIG. 1 position, lifting its O-ring seal 62 off the main valve seat 14 and thereby allowing water from the tank to flow out through the flush conduit 16.

Now, the user typically will may not keep the push button 44 depressed long enough for the required flush volume to flow. But the remote valve 46 nonetheless remains open long enough, as will now be explained by reference to FIG. 3. As that drawing shows, the push button 44 actually is a compound button consisting of outer and inner button members 64 and 66 held in a button frame 68 by a button cap 70. A flexible diaphragm 72 secured to the frame 68 by an actuator-chamber housing 74 biases the inner button 66 to the illustrated rest position, in which it additionally holds the outer button member 64 in its rest position.

Figure 4:
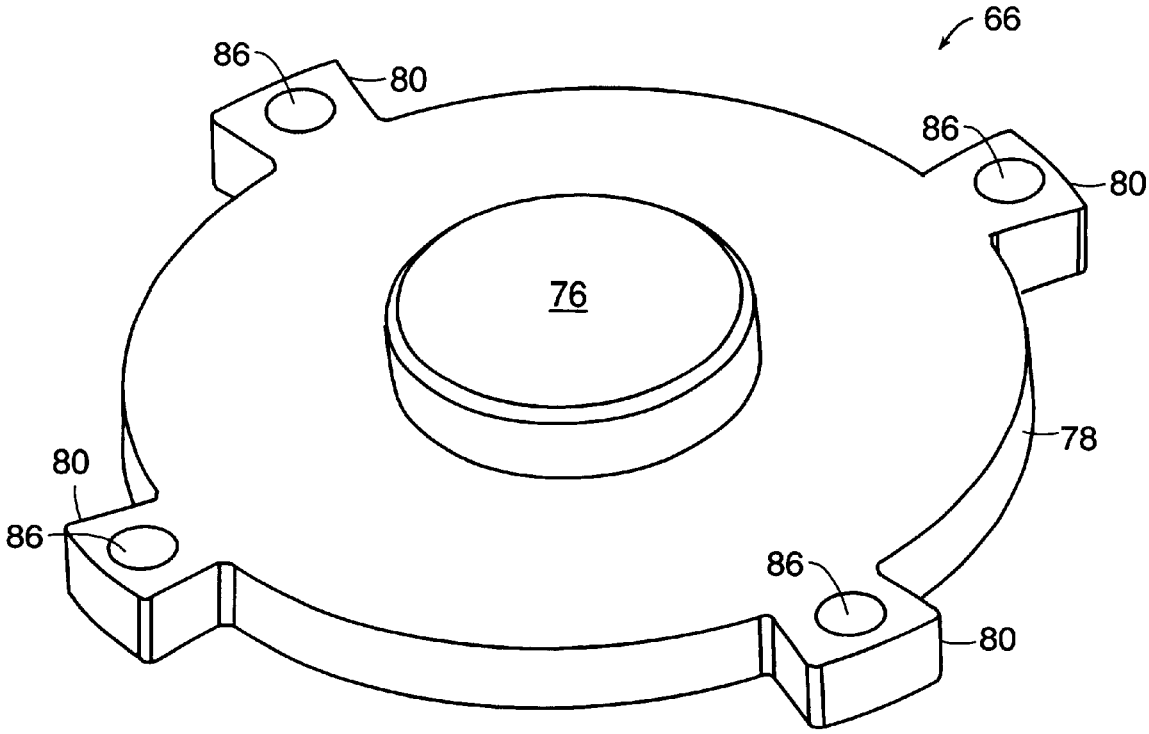
FIG. 4 is a top isometric view of one of the push-button members in the push-button assembly of FIG. 3.
Figure 5:
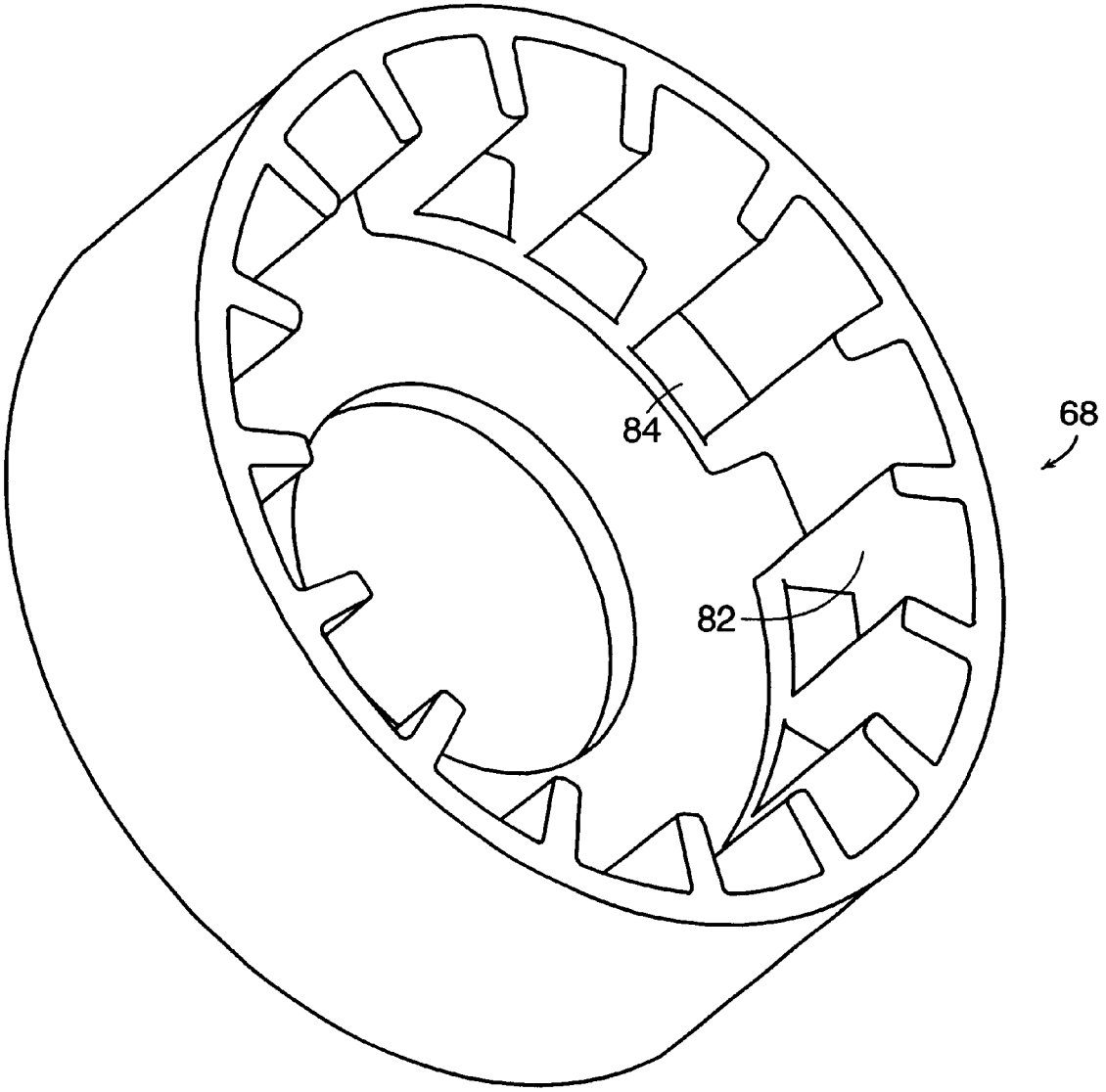
FIG. 5 is an isometric view of the button frame in FIG. 3's push-button assembly.

FIG. 4 is a top isometric view of the inner button member 66. That drawing shows that button member 66 includes a central land 76 extending from a generally disk-shaped layer 78 from which four keys 80 extend radially. As FIG. 5 shows, the button frame forms a set of sixteen partitions 82 extending radially inward. Those partitions 82 cooperate to define sixteen key guides, within any four of which FIG. 4's keys 80 can slide. The button frame 68 also forms stop surfaces 84 at the bases of the key guides thus formed. The stop surfaces 84 in the key guides occupied by the four keys at any one time are all arranged at the same level so that they stop all forms simultaneously. But different sets of four stops are disposed at different levels so that placing the keys in different sets of the key guides results in different amounts of permitted button travel, for reasons that will be explained in due course.

Figure 6:
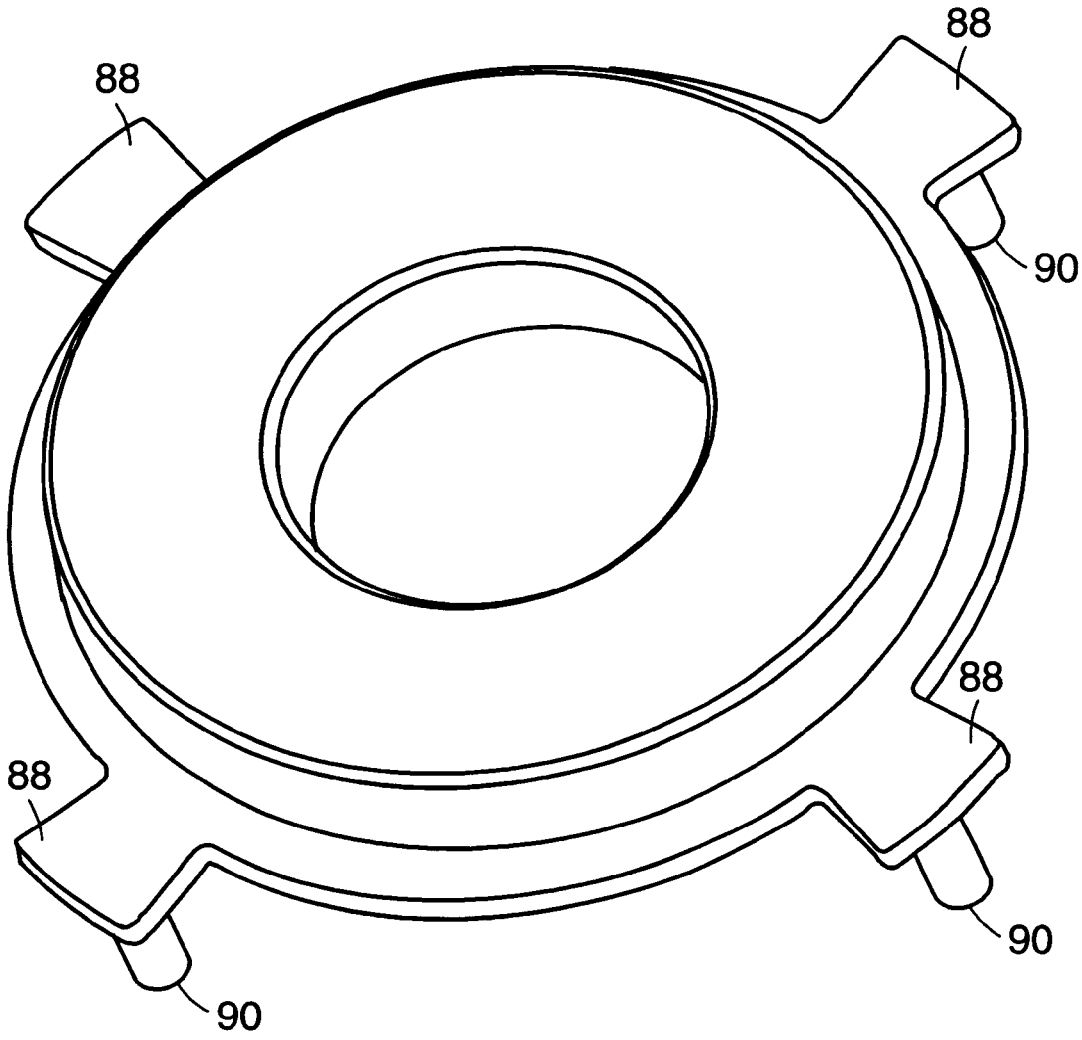
FIG. 6 is an isometric view of another button member from the push-button assembly of FIG. 3.

As FIG. 4 shows, each of the four keys 80 forms a passage 86 therethrough. FIG. 6, which is an isometric view of the outer button member 64, shows that the outer button member is generally annular but forms four radially extending tabs 88 from which respective legs 90 extend. Those legs register with FIG. 4's passages 84 and, as FIG. 3 shows, extend through them.

When the user operates the push button 44, he most often presses against the outer button member 64 and thereby depressed that member until its legs 90 reach the respective key guides' stop surface 84. The outer button member 64 bears against the inner button member 66, moving it to the right in FIG. 3 and causing it to deform the flexible diaphragm 72 from its illustrated position, to which it is biased. A valve housing 92 secured to the actuator-chamber housing 74 holds in place a second flexible diaphragm 94, which cooperates with diaphragm 72 and the actuator-chamber housing 74 to form an actuator chamber. The actuator chamber is filled with an incompressible fluid, and button member 66's deformation of diaphragm 72 forces the fluid through four angularly spaced openings 96 in a divider wall 98 that the actuator-chamber housing 74 forms. In flowing through openings 96, the fluid lifts the lip of an umbrella-type check-valve member 100 snap fit in a central divider-wall opening.

Figure 3:
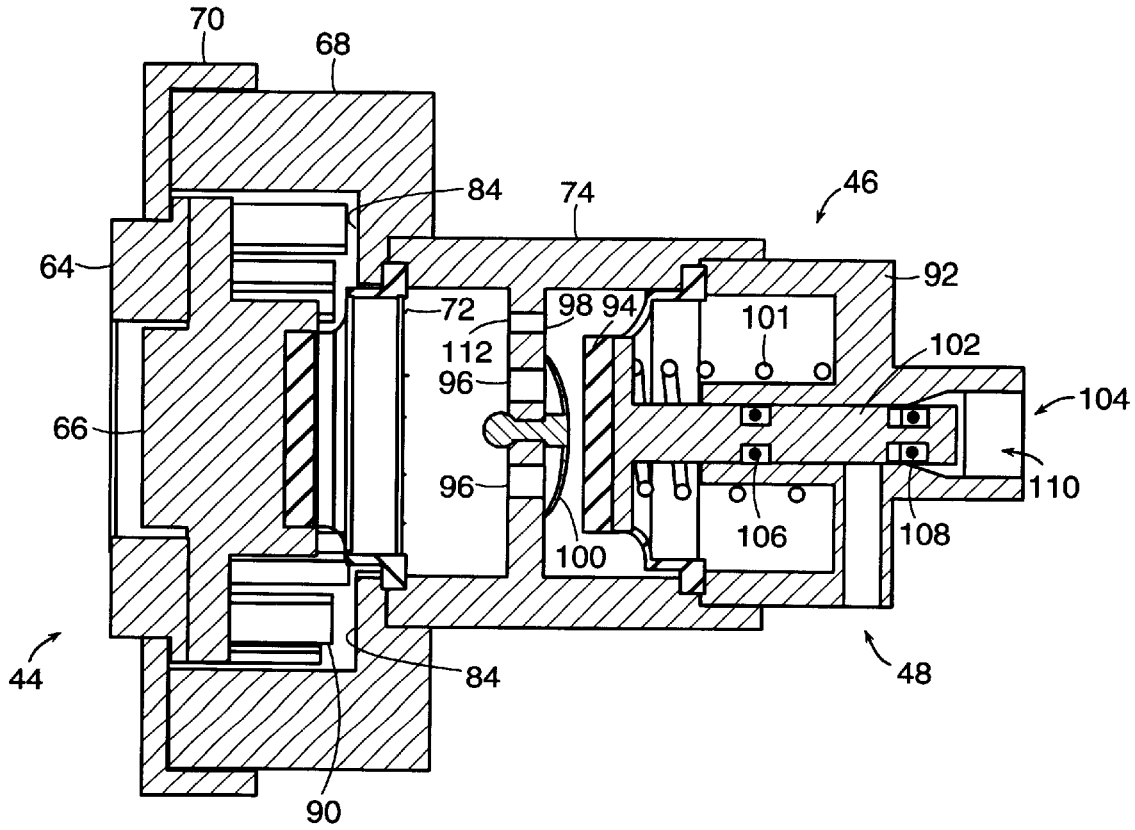
FIG. 3 is a cross-sectional view of a remote actuator valve and push button.

The fluid's motion urges diaphragm 94 rightward in FIG. 3 against the force of a bias spring 101 and thereby pushes to the right a valve member 102 slidably disposed in a valve channel 104 formed by the valve housing 92. Valve member 102 forms two annular recesses in which respective O-ring seals 106 and 108 are disposed, and the rightward motion causes O-ring 108 to extend into a widened portion 110 of channel 104 and thereby break the seal that it had theretofore maintained with the channel wall. Pressure theretofore prevailing in tube 50 is thereby relieved through channel 104 and outlet passage 48. When the user depresses only the outer button member 64, the point at which that members' legs 90 encounter their respective lands 84 determines how far into the widened channel portion 110 valve member 102 extends.

When the user releases the button, flexible diaphragms 72 and 94 tend to resume the rest positions to which spring 101 biases them, so they act to return the valve 46 to its closed state. To resume the rest positions, they must move the actuator chamber's fluid back through the dividing wall 98. But check valve 100 prevents fluid from flowing through openings 96, and the only route through the wall that remains is therefore a bleed orifice 112, which imposes significant flow resistance and therefore a delay between the user's releases of the button and valve 46's closure.

The duration of the delay depends on the amount of diaphragm deformation that occurred, and this in turn depends on how far button member 64 traveled. The amount of that travel is determined by the selection of the key guides into which that button member's keys 80 were placed; different-level stop surfaces 84 result in different amounts of travel of legs 90 before they encounter those stop surfaces, but the resultant delay is usually at least two seconds.

The delay imposed as a result of the user's depressing only the outer button member 64 is usually so selected as not to permit the tank to empty completely but still to permit enough flushing flow for most purposes. If the user desires a fuller flush, he instead depresses the inner button member 66's land 76 (FIG. 4). Button member 66 can travel farther than member 64; it can travel until its keys 80 reach respective stop surfaces 84. As a consequence, its operation causes more of the incompressible fluid to flow through the divider wall 98, and it thus requires more of the fluid to return upon the button's release before the valve 46 returns to its closed position. More of the tank's contents therefore flow into the toilet bowl to flush it.

Figure 7:
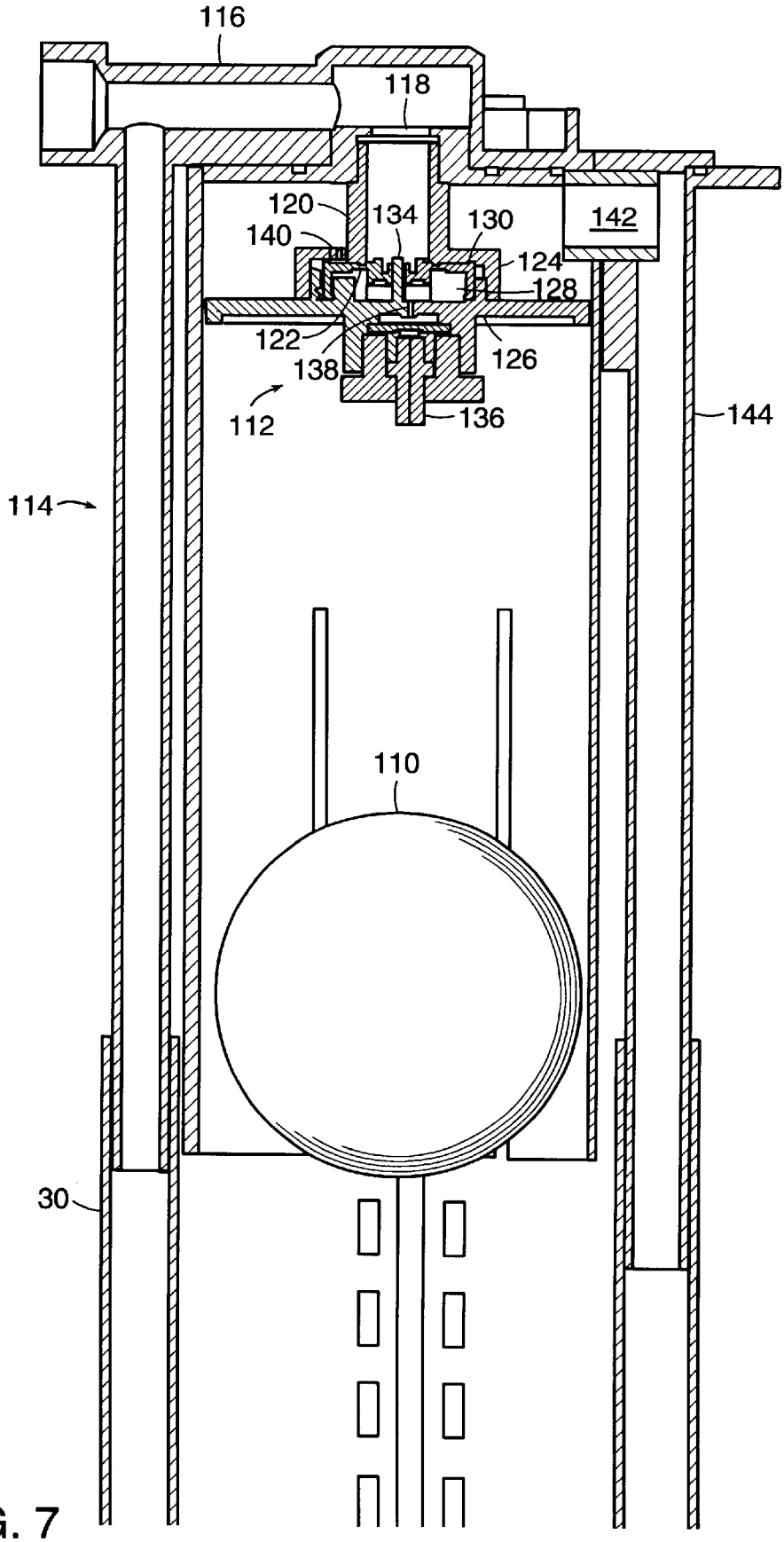
FIG. 7 is a more-detailed cross-sectional view of FIG. 1's float-valve assembly.

When the water level in the tank has fallen significantly below a full-tank level, a float 110 shown in FIG. 7 permits the float valve 112 to open. That valve is mounted in an upper main-housing half 114 supported on the lower main-housing half. The main housing is provided in two halves so that the float-valve assembly 112's height, and thus the level to which the tank is allowed to fill, can be adjusted by means not shown.

A main pressure-inlet manifold 116, which feeds the conduit 30 by which pressure chamber 24 is pressurized, forms a further outlet 118. Through this outlet it feeds a conduit 120 mounted on the upper main-housing half 114 and forming at its lower edge a float-valve seat 122. Formed integrally with the conduit 120 is a generally annular mouth portion 124 in which a pilot-chamber base 126 is threadedly secured. That base cooperates with the conduit 120's mouth portion 124 to form a float-valve pilot chamber 128 and secure within it a resiliently deformable float-valve diaphragm 130 that tends to seal against the float-valve seat 122. However, a bleed oriface in which is disposed a positioning pin 134 formed by the pilot-chamber base 126 permits fluid from the conduit 120 to enter the pilot-valve chamber 128. When a pilot-valve member 136 is held by the float 110 against the outlet of a pressure-relief passage 138, the pressure in the pilot-valve chamber 128 can build up to equal the pressure in the conduit 120 and, prevailing over a larger area than the pressure from the conduit 120, hold the float-valve diaphragm 130 seated so that it prevents the liquid in conduit 120 from flowing around the float-valve seat 122 through mouth-portion openings 140 and a port 142 to a tank-fill tube 144.

When the tank level is low, though, the float 110 does not stop pressure-relief passage 138, so pressure in the pilot-valve chamber 128 is relieved faster than it can be restored through the bleed oriface 132. The pressure in conduit 120 therefore unseats the float-valve diaphragm 130, so water from conduit 120 can flow into the fill tube 144.

Figure 8:
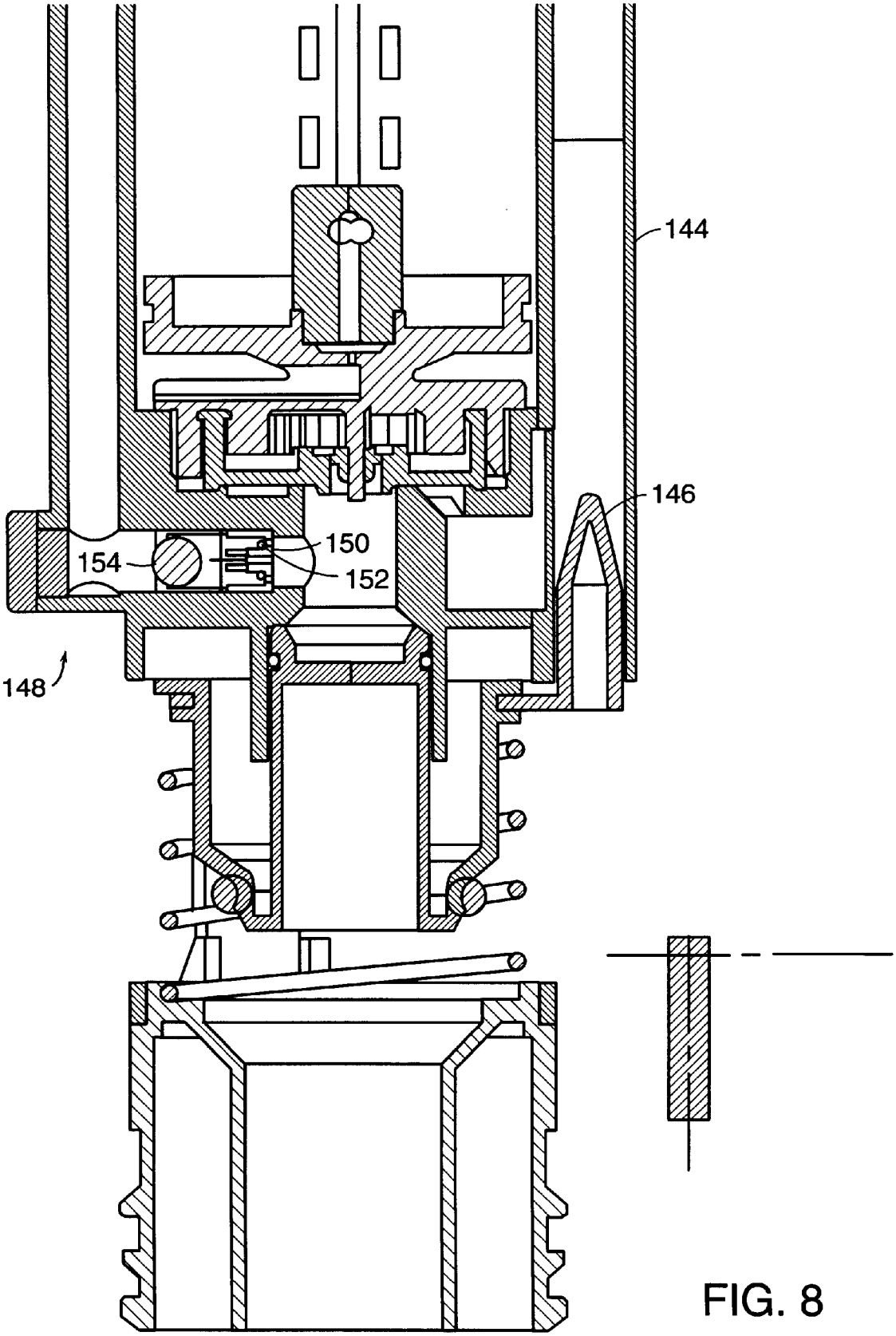
FIG. 8 is a cross-sectional view of the flush-valve assembly showing a fill tube and flow diverter.

The fill tube's purpose is to fill the tank, and the tank-filling flow tends to reduce the manifold pressure. Since that pressure is what closes the flush valve, significant tank-filling flow might impair that valve's closing performance. So long as the flush-valve member 12 is in its fully unseated position, though, water cannot flow at any significant rate from the fill tube 144 into the tank. This is because, as FIG. 8 shows, a flow restricter 146 mounted on the flush-valve member so protrudes into the fill tube's outlet as to restrict the tube's flow area greatly. This has the beneficial effect of maintaining high pressure in the manifold 116 and thus the pressure line 130 by which, through bleed oriface 140, the manifold pressure closes the pilot valve and thus imposes on the flush valve the pressure that closes it. In other words, the flow restricter ensures that there is enough pressure to close the flush valve with significant speed.

When the flush valve does close, it retracts the flow restricter 146 from the fill tube 144 and thereby allows the tank to fill rapidly.

The flow-restricter operation just described tends to make the flush valve's operation more predictable in duration than it would otherwise be; tank filling does not adversely affect the pressure that operates to close the flush valve. However, the pressure from the water source can vary, and this, too, could result in undesired variations in the delay between the remote valve's closing and that of the flush valve. A flow-rate controller 148 (FIG. 1) interposed in the flow path by which the flush-valve-closing pressure is supplied reduces this effect. The particular type of flow controller is not critical, but FIG. 8 depicts one of the deformable-ring variety. A flow restricter 150 disposed in the conduit cooperates with a resiliently deformable ring 152 to restrict the flow area through which pressurized water must flow to enter the pressure chamber that applies the closing force to the flush valve. If the supply pressure is relatively low, it does not greatly deform the ring, and the resultant flow area is relatively great: the already-low pressure is not reduced much in flowing through the restricter. If the supply pressure is high, on the other hand, it deforms the ring by a greater amount and thereby restricts the flow area more significantly. So a greater pressure drop from the originally high pressure occurs. The flow-rate controller therefore reduces the pressure variation that the flush valve would otherwise experience. This reduces variation in the speed at which the flush valve closes.

Plumbing installations can experience not only pressure variation but also total pressure loss. In the absence of the present invention, such a pressure loss would permit the flush valve to open, causing an unintended flush. But a check valve 154 is provided in the pressurizer conduit 30 so that the pressure holding the flush valve closed is not lost when the line pressure is.

What is claimed is:

1. A flusher comprising:

a toilet flush tank forming a flush outlet by which liquid in the flush tank can leave the flush tank for flushing;

a flush-valve member operable between an unseated state, in which it permits liquid to flow from the flush tank through the flush outlet into a toilet bowl, and a seated state, in which it prevents liquid to flow from the flush tank therethrough; said flush valve member being biased to said unseated state by force of a bias member and being forced to said seated state by at least a portion of water pressure from said external source;

a valve-operating mechanism including a housing that defines a control chamber, forms a line-pressure inlet that admits water having a line pressure into the control chamber, and forms a control-chamber pressure-relief outlet, by which pressure in the control chamber can be relieved, the valve-operating mechanism operating the flush-valve member to its seated state when the line pressure prevails in the control chamber and operating the flush-valve member to its unseated state when the pressure in the control chamber is relieved;

a pressurizer conduit having an upstream end and a downstream end that communicates with the control chamber that pressurized water applied to the pressurizer conduit at the upstream end thereof can pressurize the control chamber and cannot flow downstream out of the pressurizer conduit without flowing into the control chamber; and a check valve interposed in the pressurizer conduit and oriented to permit water under pressure to flow toward the pressurizer conduit's downstream end but not toward its upstream end and thereby maintain pressure in the control chamber when there is no pressurized water applied at the upstream end, wherein the bias member is capable of moving the flush valve member to said unseated state when there is no pressurized water applied at the upstream end.

2. The flusher of claim 1 wherein said valve-operating mechanism includes a diaphragm.

3. The flusher of claim 1 including an intake valve that includes a float.

4. The tank-type flusher of claim 3 wherein said float is constructed and arranged to freely float.

5. A tank-type flusher, comprising:

an intake valve connected to an external water source and constructed to close water flow to a water storage toilet flush tank at about a predefined water level in said flush tank;

a diaphragm-operated flush valve constructed to control a flush valve member between a seated state and an unseated state allowing water discharge from said flush tank into a toilet bowl; said flush valve member being biased to said unseated state by force of a bias member and being forced to said seated state by at least a portion of water pressure from said external source;

a diaphragm separating a pressure chamber and a pilot chamber, pressure in said pressure chamber forcing said flush valve member to said seated state thereby preventing said water discharge from said water storage toilet flush tank to said toilet bowl;

a pressure control mechanism constructed and arranged, upon actuation, to reduce pressure in said pilot chamber and thereby reduce pressure in said pressure chamber causing said flush valve member to move to said unseated state;

a pressurizer conduit having an upstream end and a downstream end and being arranged to provide to said pressure chamber pressurized water applied to said pressurizer conduit at said upstream end; and a check valve oriented to permit water under pressure to flow toward said pressure chamber and arranged to maintain pressure in said pressure chamber when no pressure is applied to said upstream end of said pressurizer conduit, wherein the bias member is capable of moving the flush valve member to said unseated state when there is no pressurized water applied at the upstream end.

6. The tank-type flusher of claim 5 wherein said intake valve includes a float constructed and arranged without any fixed coupling to any valve member.

7. The tank-type flusher of claim 5 wherein said intake valve includes a float which freely floats.

8. The tank-type flusher of claim 5 wherein said intake valve includes a float arranged to float and constructed to block a relief orifice at said predefined water level.

9. The tank-type flusher of claim 5 wherein said flush valve member is constructed to move linearly within a flush valve housing between said seated and unseated states.

10. The tank-type flusher of claim 5 further including a flow restrictor reducing water flow to said storage tank from said external water source when said flush valve member is in said unseated state.

11. The tank-type flusher of claim 5 further including a flow rate controller associated with said pressurizer conduit.

12. A tank-type flusher, comprising:

an intake valve constructed to close water flow from an external water source to a water storage toilet flush tank when there is a predefined water level in said flush tank, said intake valve including a float constructed and arranged to freely float within a linearly restricting member and cause closing of an orifice and thereby close said water flow from said external source at said predefined water level;

a diaphragm-operated flush valve including a pressure chamber, said diaphragm-operated flush valve being constructed to open upon actuation to discharge water into a toilet bowl from said flush tank; and a pressurizer conduit in communication with a check valve located and oriented to permit water under pressure to flow toward said pressure chamber and arranged to maintain pressure in said pressure chamber when no pressurized water is applied to said pressurizer conduit.

13. The tank-type flusher of claim 12 wherein said intake valve and said flush valve are located within a single housing.

14. The tank-type flusher of claim 12 further including a flow rate controller associated with said pressurizer conduit.

15. The tank-type flusher of claim 12 wherein said diaphragm-operated flush valve is hydraulically controlled.

16. A tank-type flusher, comprising:

an intake valve connected to an external water source and constructed to close water flow to a water storage toilet flush tank at about a predefined water level in said flush tank; and a flush valve constructed to control position of a flush valve member movable between a seated state and an unseated state allowing water discharge from said flush tank into a toilet bowl; said flush valve member being biased to said unseated state by force of a bias member and being forced to said seated state by at least a portion of water pressure from said external source;

a pressurizer conduit having an upstream end and a downstream end and being arranged to provide said pressure chamber pressurized water applied to said pressurizer conduit at said upstream end; and a check valve oriented to permit water under pressure to flow toward said pressure chamber and arranged to maintain pressure in said pressure chamber when no pressure is applied to said upstream end of said pressurizer conduit and thereby maintain said biased flush valve member in said seated state, wherein the bias member is capable of moving the flush valve member to said unseated state when there is no pressurized water applied at the upstream end.

17. The tank-type flusher of claim 16 wherein said pressure chamber is arranged to prevent said water discharge utilizing at least a portion of said pressurized water applied to said pressurizer conduit at said upstream end.

18. The tank-type flusher of claim 16 further including a flow restrictor reducing water flow to said storage tank from said external water source when said flush valve member is in said unseated state.

19. The tank-type flusher of claim 16 further including a flow rate controller associated with said pressurizer conduit.

20. The tank-type flusher of claim 16 wherein said intake valve and said flush valve are located within a single housing.

* * * * *